US009550230B2

(12) United States Patent
Lutjen et al.

(10) Patent No.: US 9,550,230 B2
(45) Date of Patent: Jan. 24, 2017

(54) MOLD FOR CASTING A WORKPIECE THAT INCLUDES ONE OR MORE CASTING PINS

(75) Inventors: Paul M. Lutjen, Kennebunkport, ME (US); Christopher W. Strock, Kennebunk, ME (US)

(73) Assignee: United Technologies Corporation, Farmington, CT (US)

( * ) Notice: Subject to any disclaimer, the term of this patent is extended or adjusted under 35 U.S.C. 154(b) by 493 days.

(21) Appl. No.: 13/234,966

(22) Filed: Sep. 16, 2011

(65) Prior Publication Data

US 2013/0068415 A1 Mar. 21, 2013

(51) Int. Cl.

| | |
|---|---|
| ***B22C 9/04*** | (2006.01) |
| ***B22C 9/10*** | (2006.01) |
| ***B22C 9/24*** | (2006.01) |

(52) U.S. Cl.

CPC ..... *B22C 9/04* (2013.01); *B22C 9/108* (2013.01); *B22C 9/24* (2013.01)

(58) Field of Classification Search

CPC ..... B22C 9/108; B22C 9/04; B22C 9/24; B22C 21/14

See application file for complete search history.

(56) References Cited

U.S. PATENT DOCUMENTS

| | | | | |
|---|---|---|---|---|
| 2,017,952 | A * | 10/1935 | Ditty | 164/399 |
| 3,659,645 | A * | 5/1972 | Rose | 164/353 |
| 4,487,246 | A * | 12/1984 | Frasier | 164/32 |
| 5,950,705 | A * | 9/1999 | Huang | 164/137 |
| 6,077,006 | A | 6/2000 | Nelson | |
| 7,036,556 | B2 | 5/2006 | Caputo et al. | |
| 7,334,985 | B2 | 2/2008 | Lutjen et al. | |
| 7,887,929 | B2 | 2/2011 | Strock et al. | |
| 7,892,652 | B2 | 2/2011 | Strock et al. | |
| 7,998,604 | B2 | 8/2011 | Reynolds et al. | |
| 2004/0094287 | A1 | 5/2004 | Wang | |
| 2009/0165988 | A1 * | 7/2009 | Rockstroh et al. | 164/492 |
| 2010/0136258 | A1 | 6/2010 | Strock et al. | |
| 2010/0226762 | A1 | 9/2010 | Lutjen et al. | |
| 2011/0203286 | A1 | 8/2011 | Wagner et al. | |

FOREIGN PATENT DOCUMENTS

| | | | |
|---|---|---|---|
| JP | 09001315 A | * | 1/1997 |

* cited by examiner

*Primary Examiner* — Kevin E Yoon
*Assistant Examiner* — Jacky Yuen
(74) *Attorney, Agent, or Firm* — O'Shae Getz P.C.

(57) ABSTRACT

A mold for casting a workpiece that includes a casting shell, a casting core and casting pin that supports the core within the shell. The casting shell includes an interior shell surface. The casting core is located within the shell, and includes a sidewall extending between a first core surface and a second core surface. The casting pin includes an intermediate segment connected between a first support segment and a second support segment. The intermediate segment contacts the sidewall. The first support segment extends from the first core surface to a first side of the interior shell surface. The second support segment extends from the second core surface to a second side of the interior shell surface that is opposite the first side.

16 Claims, 3 Drawing Sheets

MOLD FOR CASTING A WORKPIECE THAT INCLUDES ONE OR MORE CASTING PINS

BACKGROUND OF THE INVENTION

1. Technical Field

This disclosure relates generally to a mold for casting a workpiece and, more particularly, to a mold that includes one or more casting pins.

2. Background Information

Various methods for investment casting (also referred to as "lost wax casting") are known in the art for manufacturing a hollow workpiece. An example of a hollow workpiece is a component such as a hollow rotor blade for a gas turbine engine. In one such method, molten metal is poured into a mold cavity defined between an exterior core surface of a casting core and an interior shell surface of a casting shell. The casting core may be supported within the casting shell using a plurality of casting pins. Each casting pin typically extends from the exterior core surface through the mold cavity and into the casting shell. Therefore, while a casting pin may prevent the casting core from moving in a direction that extends therethrough, the casting pin typically does not prevent the casting core from moving in an opposite direction that extends away therefrom. Such casting pins therefore are typically used in pairs, where a first casting pin is arranged on one side of the casting core, and where a second casting pin is arranged on an opposite side of the casting core.

SUMMARY OF THE DISCLOSURE

According to one aspect of the invention, a mold is provided for casting a workpiece. The mold includes a casting shell, a casting core and casting pin that supports the core within the shell. The casting shell includes an interior shell surface. The casting core is located within the shell, and includes a sidewall extending between a first core surface and a second core surface. The casting pin includes an intermediate segment connected between a first support segment and a second support segment, and the intermediate segment contacts the sidewall. The first support segment extends from the first core surface to a first side of the interior shell surface. The second support segment extends from the second core surface to a second side of the interior shell surface that is opposite the first side.

The foregoing features and the operation of the invention will become more apparent in light of the following description and the accompanying drawings.

DETAILED DESCRIPTION OF THE INVENTION

Figure 1:
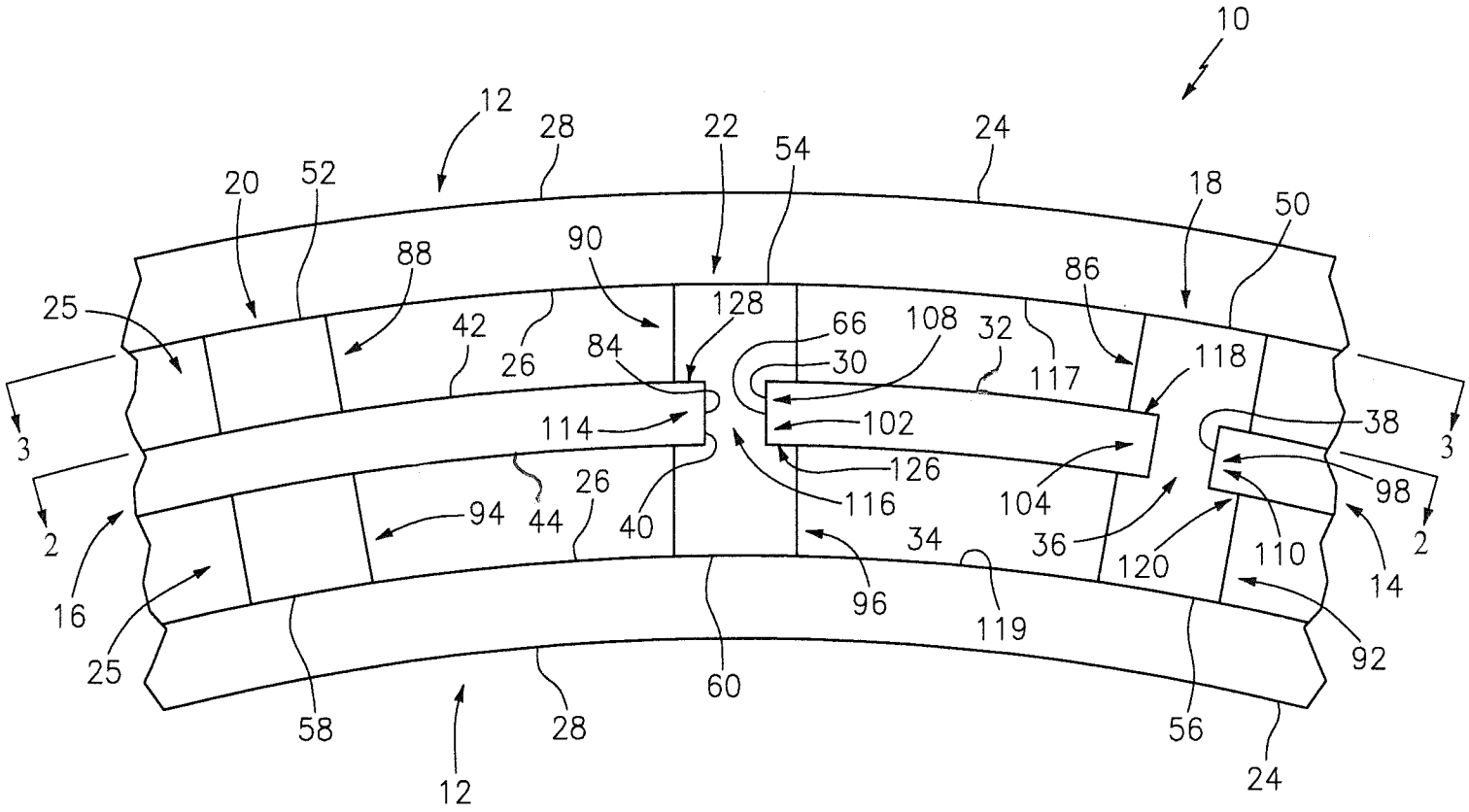
FIG. 1 is a cross-sectional illustration of a mold for casting a workpiece.

FIG. 1 is a cross-sectional illustration of a mold 10 for casting a hollow workpiece. The mold 10 includes a casting shell 12, one or more casting cores 14 and 16, and one or more casting pins 18, 20 and 22.

The casting shell 12 includes a shell wall 24 that defines an interior shell cavity 25. The shell wall 24 extends between an interior shell surface 26 and an exterior shell surface 28.

Figure 2:
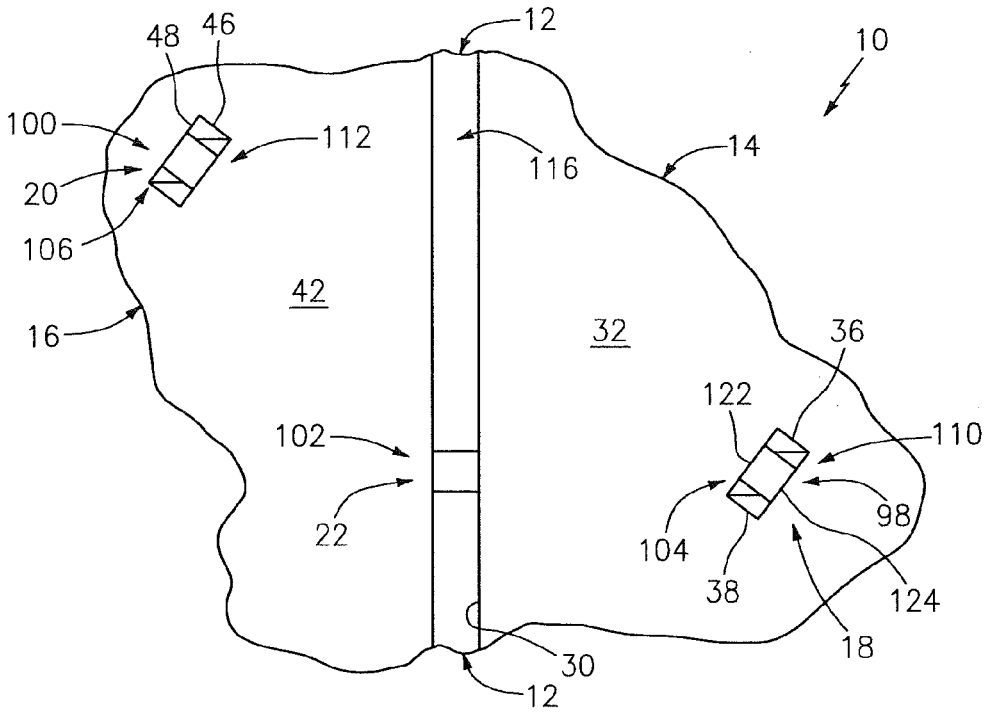
FIG. 2 is a sectional illustration of the mold illustrated in FIG. 1.

The casting cores may include a first casting core 14 and a second casting core 16. The first casting core 14 includes a core sidewall 30, a first core surface 32, a second core surface 34 and at least one aperture 36. The core sidewall 30 extends between the first core surface 32 and the second core surface 34. Referring to FIG. 2, the aperture 36 may have a rectangular cross-sectional geometry that extends through the first casting core 14. Referring again to FIG. 1, the aperture 36 includes an aperture sidewall 38 that extends between the first core surface 32 and the second core surface 34.

The second casting core 16 includes a core sidewall 40, a first core surface 42, a second core surface 44 and at least one aperture 46 (see FIG. 2). The core sidewall 40 extends between the first core surface 42 and the second core surface 44. Referring to FIG. 2, the aperture 46 may have a rectangular cross-sectional geometry that extends through the second casting core 16. The aperture 46 includes an aperture sidewall 48 that extends between the first core surface 42 and the second core surface 44.

Figure 3:
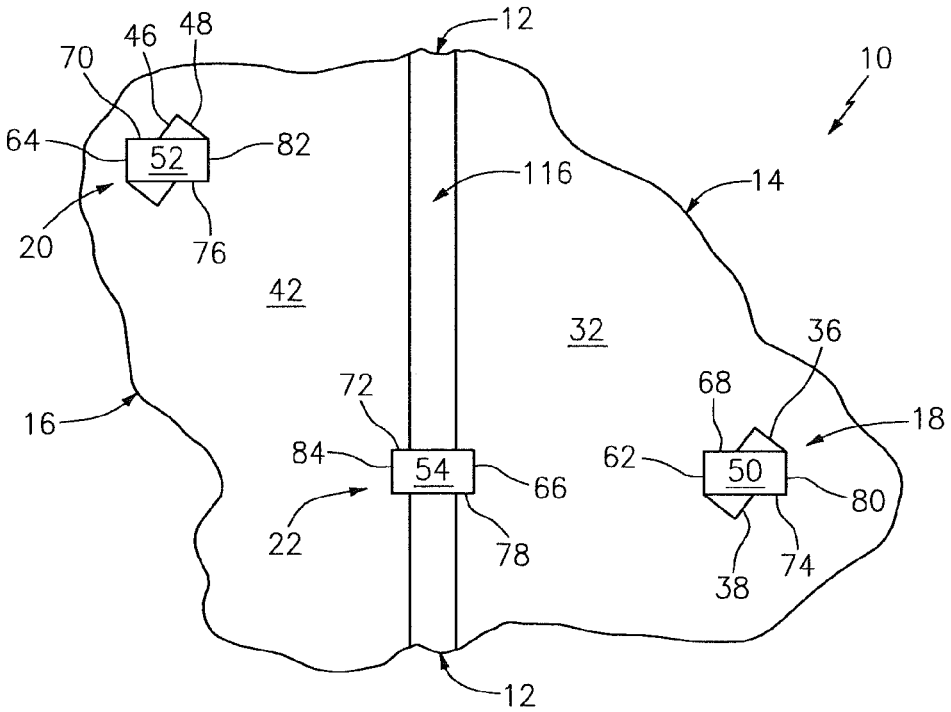
FIG. 3 is a sectional illustration of the mold illustrated in FIG. 1.

Referring again to FIG. 1, the casting pins may include a first casting pin 18, a second casting pin 20, and a third casting pin 22. Each casting pin 18, 20, 22 has one or more pin sidewalls that extend axially between a first pin end 50, 52, 54 and a second pin end 56, 58, 60, respectively. Referring to FIG. 3, the pin sidewalls may include a first pin sidewall 62, 64, 66, a second pin sidewall 68, 70, 72, a third pin sidewall 74, 76, 78 and a fourth pin sidewall 80, 82, 84, respectively. The first pin sidewall 62, 64, 66 and the fourth pin sidewall 80, 82, 84 each extend between the second pin sidewall 68, 70, 72 and the third pin sidewall 74, 76, 78, respectively.

Referring again to FIG. 1, each casting pin 18, 20, 22 includes a first support segment 86, 88, 90, a second support segment 92, 94, 96, an intermediate segment 98, 100, 102 (see FIG. 2), and one or more notches. The first support segment 86, 88, 90 extends between the intermediate segment 98, 100, 102 and the first pin end 50, 52, 54, respectively. The second support segment 92, 94, 96 extends between the intermediate segment 98, 100, 102 and the second pin end 56, 58, 60, respectively. The intermediate segment 98, 100, 102 extends between the first support segment 86, 88, 90 and the second support segment 92, 94, 96. Referring to FIGS. 1 and 2, the notches may include a first notch 104, 106, 108 and a second notch 110, 112, 114, respectively. The first notch 104, 106, 108 extends into the first pin sidewall 62, 64, 66 between the first support segment 86, 88, 90 and the second support segment 92, 94, 96, respectively. The second notch 110, 112, 114 extends into the fourth pin sidewall 80, 82, 84 between the first support segment 86, 88, 90 and the second support segment 92, 94, 96, respectively. In the embodiment in FIG. 2, the notches provide the intermediate segment 98, 100, 102 with a rectangular cross-sectional geometry (e.g., rectangle or square shaped geometry).

Referring to FIG. 1, the first casting core 14 and the second casting core 16 are arranged side-by-side within the interior shell cavity. The core sidewall 30 is separated from the core sidewall 40 by a gap 116.

The first casting pin 18 and the second casting pin 20 respectively support the first casting core 14 and the second casting core 16 within the casting shell 12. The first casting pin 18, for example, extends through the aperture 36 between opposing first and second sides 117 and 119 of the interior shell surface 26. A first region 118 of the first casting core 14 adjacent to the aperture sidewall 38 extends into the first notch 104. A second region 120 of the first casting core 14 adjacent to the aperture sidewall 38 extends into the second notch 110, and the aperture sidewall 38 contacts the intermediate segment 98. The first support segment 86 extends from the first core surface 32 to the first side 117 of the interior shell surface 26. The second support segment 92 extends from the second core surface 34 to the second side 119 of the interior shell surface 26.

The third casting pin 22 supports the first casting core 14 and the second casting core 16 within the casting shell 12, and aligns adjacent ends of the first casting core 14 and the second casting core 16. The third casting pin 22, for example, extends through the gap 116 between the first and second sides 117 and 119 of the interior shell surface 26. A first region 126 of the first casting core 14 adjacent to the core sidewall 30 extends into the first notch 108, and the core sidewall 30 contacts the intermediate segment 102. A second region 128 of the second casting core 16 adjacent to the core sidewall 40 extends into the second notch 114, and the core sidewall 40 contacts the intermediate segment 102. The first support segment 90 extends from the first core surfaces 32 and 42 to the first side 117 of the interior shell surface 26. The second segment 96 extends from the second core surfaces 34 and 44 to the second side 119 of the interior shell surface 26.

In some embodiments, the casting shell 12 and/or the casting cores 14 and 16 may be manufactured from ceramic. In some embodiments, the casting pins 18, 20 and 22 may be manufactured from metal (e.g., platinum).

During assembly, the casting pins 18, 20 and 22 are respectively mated to the first casting core 14 and the second casting core 16. For example, referring to FIGS. 1-3, the first support segment 86 may be passed through the aperture 36 until the intermediate segment 98 is aligned with the first casting core 14. The first support segment 86 and the second support segment 92 may be twisted relative to the intermediate segment 98 and the aperture 36 such that the first support segment partially overlaps the first core surface 32 and the second support segment partially overlaps the second core surface 34. The first and the second support segments 86 and 92 may twist relative to the intermediate segment 98, for example, through plastic deformation at intersections between the support segments and the intermediate segment.

A wax die may be formed around the first casting core 14 and the second casting core 16, and at least partially encapsulate the casting pins 18, 20 and 22. The casting shell 12 may subsequently be formed around the wax die, which may be removed to form the interior shell cavity 25. Alternatively, one or more of the casting pins 18, 20 and 22 may be respectively mated to the first casting core 14 and the second casting core 16 after the wax die is formed around the first casting core 14 and the second casting core 16.

Figure 4:
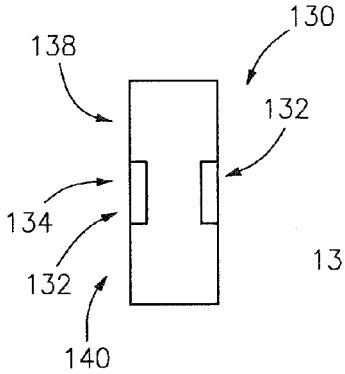
FIG. 4 is an illustration of a casting pin.
Figure 5:
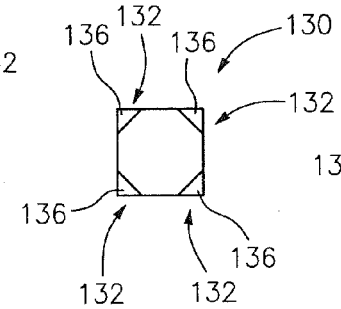
FIG. 5 is a cross-sectional illustration of the casting pin illustrated in FIG. 4.
Figure 6:
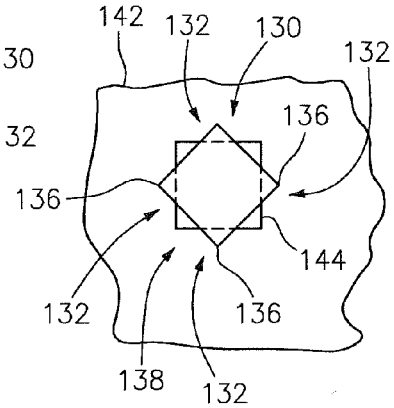
FIG. 6 is a sectional illustration of a mold for casting a workpiece that includes the casting pin illustrated in FIG. 4.

FIG. 4 illustrates an alternate embodiment of a casting pin 130. FIG. 5 is a cross-section illustration of the casting pin 130 illustrated in FIG. 4. Referring to FIGS. 4 and 5, in contrast to the casting pins 18, 20 and 22 illustrated in FIG. 1, the casting pin 130 has a substantially square cross-sectional geometry, and includes a plurality of corner notches 132. Each corner notch 132 extends into an intermediate segment 134, at a corner 136 of the casting pin 130, between first and second support segments 138 and 140. FIG. 6 illustrates the casting pin 130 connected to a casting core 142 through an aperture 144 having a substantially square cross-sectional geometry.

Figure 7:
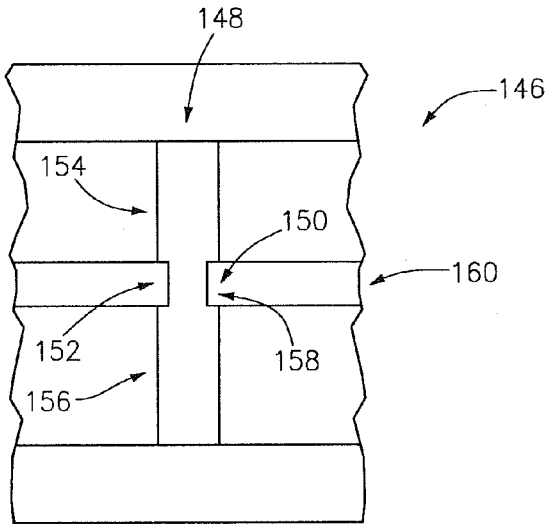
FIG. 7 is a cross-sectional illustration of a mold for casting a workpiece.
Figure 8:
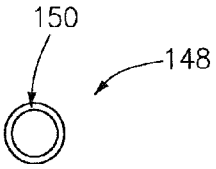
FIG. 8 is a cross-sectional illustration of a casting pin included in the mold illustrated in FIG. 7.

FIG. 7 is a cross-sectional illustration of a mold 146 for casting a workpiece that includes an alternate embodiment of a casting pin 148. FIG. 8 is a cross-sectional illustration of the casting pin 148 illustrated in FIG. 7. Referring to FIGS. 7 and 8, in contrast to the casting pins 18, 20 and 22 illustrated in FIG. 1, the casting pin 148 has a substantially circular cross-sectional geometry, and includes an annular notch 150. The annular notch 150 extends into an intermediate segment 152 between first and second support segments 154 and 156. The annular notch 150 may be formed after the casting pin 148 is inserted into an aperture 158 in a casting core 160 by axially compressing the casting pin 148.

In other embodiments, the first and/or the second pin ends may extend into the casting shell. The first and/or the second pin ends may also extend into a wax die mold during the formation of the wax die to locate the casting cores.

In still other embodiments, one or more of the support segments of one or more of the casting pin may have a stepped geometry where, for example, an outer step extends into the casting shell.

While various embodiments of the present invention have been disclosed, it will be apparent to those of ordinary skill in the art that many more embodiments and implementations are possible within the scope of the invention. Accordingly, the present invention is not to be restricted except in light of the attached claims and their equivalents.

What is claimed is:

1. A mold for casting a workpiece, comprising:

a casting shell comprising an interior shell surface;

a casting core located within the shell, and comprising a sidewall extending between a first core surface and a second core surface; and a casting pin supporting the core within the shell, and comprising an intermediate segment connected between a first support segment and a second support segment, wherein the intermediate segment contacts the sidewall, the first support segment extends from the first core surface to a first side of the interior shell surface, and the second support segment extends from the second core surface to a second side of the interior shell surface that is opposite the first side;

wherein the casting pin further comprises a first notch that is completely defined by the intermediate segment, the first notch extending into the casting pin between the first and the second support segments, and a first region of the core adjacent the sidewall extends into the first notch;

wherein an aperture extends through the core between the first and the second core surfaces, and wherein the aperture comprises the sidewall; and wherein the casting pin and the core are configured such that the casting pin is operable to be inserted into the aperture and twisted in order to interlock the casting pin with the core after the core has been formed.

2. The mold of claim 1, wherein the casting pin further comprises a first pin sidewall extending between a second pin sidewall and a third pin sidewall, and the notch extends into the first pin sidewall, and between the second and the third pin sidewalls.

3. The mold of claim 1, wherein the casting pin further comprises a corner between a first pin sidewall and a second pin sidewall, and the notch extends from the corner partially into the first and the second pin sidewalls.

4. The mold of claim 1, wherein the casting pin further comprises a second notch that is completely defined by the intermediate segment, the second notch extending into the casting pin between the first and the second support segments, and a second region of the core adjacent to the aperture extends into the second notch.

5. The mold of claim 4, wherein the first notch and the second notch are arranged on substantially opposite sides of the casting pin.

6. The mold of claim 1, wherein the core comprises a first core, and the casting pin further supports a second core within the shell, and wherein the casting pin is located in a gap between the sidewall of the first core and a sidewall of the second core.

7. The mold of claim 6, wherein the casting pin aligns adjacent ends of the first and the second cores.

8. The mold of claim 7, wherein the casting pin further comprises a second notch that is completely defined by the intermediate segment, the second notch extending into the casting pin between the first and the second support segments, and a first region of the second core adjacent to the sidewall thereof extends into the second notch.

9. The mold of claim 1, wherein at least one of the first and the second support segments extends into the shell.

10. The mold of claim 1, wherein the casting pin is one of a plurality of casting pins that support the core within the shell.

11. The mold of claim 1, wherein the intermediate segment comprises a rectangular cross-sectional geometry.

12. The mold of claim 11, wherein the intermediate segment comprises a square cross-sectional geometry.

13. The mold of claim 1, wherein the shell and the core each comprises ceramic, and wherein the casting pin comprises metal.

14. A mold for casting a workpiece, comprising:

a casting shell comprising an interior shell surface;

a casting core located within the shell, the casting core comprising a sidewall extending in a first direction between a first core surface and a second core surface; and a casting pin supporting the core within the shell, and comprising an intermediate segment connected between a first support segment and a second support segment, wherein the intermediate segment contacts the sidewall, the first support segment extends from the first core surface to a first side of the interior shell surface, and the second support segment extends from the second core surface to a second side of the interior shell surface that is opposite the first side;

wherein the casting pin further comprises a first notch that extends into the casting pin between the first support segment and the second support segment;

wherein a first region of the core adjacent the sidewall extends into the first notch, and which first region extends between the first core surface and the second core surface; and wherein a thickness of the first region and another adjacent region of the core in the first direction is approximately equal to a length of the first notch in the first direction, and wherein the other adjacent region surrounds the first region, extends between the first and the second core surfaces and is disposed outside the first notch.

15. The mold of claim 14, wherein the casting pin is configured to be mated with the core after the core has been formed.

16. The mold of claim 1, wherein the first core surface and the second core surface proximate the casting pin are parallel to one another, and the sidewall is perpendicular to the first and the second core surfaces.

* * * * *